US005878540A

United States Patent [19]

Morstein

[11] Patent Number: 5,878,540

[45] Date of Patent: Mar. 9, 1999

[54] UTILITY POLE BASE PAN WITH DRAIN

[75] Inventor: Jerome Neil Morstein, Columbia, Md.

[73] Assignee: Site Photometrics, Inc., Lithicum, Md.

[21] Appl. No.: 928,731

[22] Filed: Sep. 12, 1997

[51] Int. Cl.[6] ..... E02D 27/00

[52] U.S. Cl. ..... 52/296; 52/292

[58] Field of Search ..... 52/292, 296; 298/519, 298/523

[56] References Cited

U.S. PATENT DOCUMENTS

| | | | |
|---|---|---|---|
| 981,610 | 1/1911 | Bolsterli | 52/292 X |
| 3,343,322 | 9/1967 | Lurkis et al. . | |
| 3,400,905 | 9/1968 | Van Dusen . | |
| 3,671,738 | 6/1972 | Beachley . | |
| 4,295,308 | 10/1981 | Korfanta | 52/296 |
| 4,878,160 | 10/1989 | Reneau et al. . | |
| 5,067,592 | 11/1991 | Miskin et al. | 52/296 X |

*Primary Examiner*—Creighton Smith
*Attorney, Agent, or Firm*—Donald C. Casey, Esq.

[57] ABSTRACT

A mounting pan for a hollow utility pole to mount the same on a concrete support is described. The pan includes an upper mounting plate for securing the same to the pole base, and simultaneously to the concrete support wherein a toroidal recess is provided between the base of the plate and the concrete support for the accumulation of moisture within the pole structure and gravity drains therefrom are provided to eliminate the accumulatedd moisture from the structure.

6 Claims, 3 Drawing Sheets

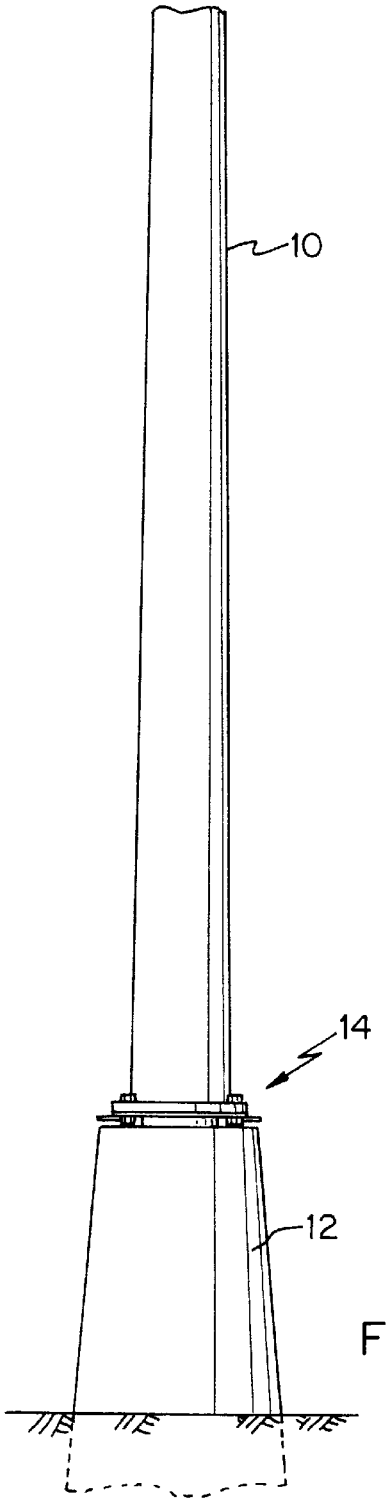
FIG. 1
FIG. 2
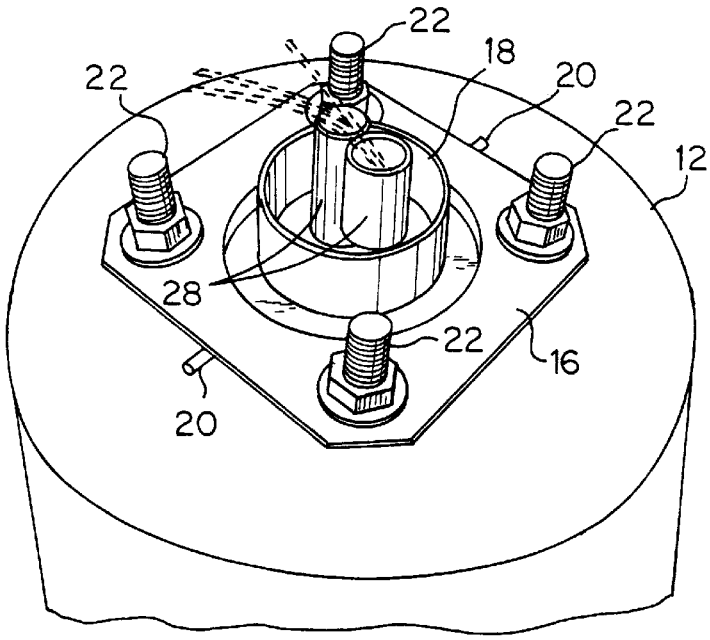

UTILITY POLE BASE PAN WITH DRAIN

BACKGROUND

1. Field of Invention

This invention relates to a support for a utility pole such as the type used for illumination in commercial surface parking lots, and may be adapted to any type of installation utilizing a vertically disposed hollow support pole.

2. Description of the Prior Art

Outdoor pole assemblies for supporting electrical devices can be substantial installations wherein a support pole is mounted on a base and electrical conduits extend upwardly through the base and through the pole to a light structure mounted on the top of the pole. Such constructions are shown for example in U.S. Pat. Nos. 3,343,322; 3,400,905; 3,671,738; and 4,878,160. Typically the base of the pole includes a mounting plate which extends perpendicularly to the longitudinal axis of the pole and which provides peripheral openings for receiving bolts so that the pole itself can be bolted to a permanent mount. In many instances the permanent mount is of concrete, set in the ground, and the bolts extend upwardly from the upper face thereof so that the holes in the pole support plate receive bolts set in the concrete mount. Setting nuts and washers are placed on each boit sot that the support plate can be temporarily supported. Adjusting the setting bolts allows for plumbing of the vertical light pole shaft. Once proper alignment is achieved, high strength grout is placed between the top at the support structure and the underside of the support plate, thereby uniformly distributing the loads.

In the case of lighting installations for large surface parking lots, for example, the pole can be quite tall and therefore considerable force can be exerted on the base during a windstorm. Therefore it is necessary that the base be a substantial structure, but still provide an internal passageway for the electrical conduits which ultimately extend up the inside of the support pole structure to the light fixture at the top thereof.

A particular disadvantage of such hollow pole structures is the lack of provision for moisture which accumulates within the hollow pole structure, as the grout placed between the top of the support and the underside of the support plate will not allow captured moisture to escape. The use of field installed weep tubes is irregular and generally ineffective. Condensation occurs due to the change in ambient temperature, and the pole assembly is not normally watertight so that during rainstorms or the like, moisture may invade the interior of the pole structure.

The moisture thus entering the pole structure is not initially a substantial problem in that it is not normally present in a large quantity. However, over a period of time the accumulation will build and can result in deterioration of the light pole shaft and connections within the pole structure.

SUMMARY OF THE INVENTION

It has been discovered however that a stable mount for a pole assembly structure can be provided which also permits the removal of accumulated moisture from within the pole structure. In this instance, a support pan is provided for mounting the pole mounting plate and the support pan includes a toroidal recess which communicates with the interior of the pole. The support pan is itself mounted on the supporting concrete structure. The support pan then includes at least one drain external thereto so that water accumulating within the pole will flow into the recess and outwardly through the drain without accumulating therein.

Accordingly it is an object of this invention to provide a support for an electrical pole assembly structure which has an internal drain therein so that water accumulating in the hollow pole structure can be expelled by gravity.

It is another object of this invention to provide a drain pan disposed on the mounting structure for an electrical lighting pole assembly wherein one or more drains are provided without weakening of the pole support.

It is still another object of this invention to provide a drain pan for the support structure for an electrical lighting pole assembly which is compatible with conventional pole assembly mounting plates so that the pole assembly can be mounted on its base in the conventional fashion but drains in the base are provided so that moisture will not be permitted to accumulate within the hollow pole structure and which also serves a template for anchor bolts during the construction of the light pole base, to ensure proper alignment of the bolts.

These and other objects will become readily apparent with reference to the drawings and following description wherein:

BRIEF DESCRIPTION OF THE DRAWINGS

FIG. 1 is a fragmentary side view of the support and pole assembly according to this invention.

FIG. 2 is a fragmentary perspective view of the drain pan of this invention in an installation with the light pole base plate removed.

DETAILED DESCRIPTION OF THE PREFERRED EMBODIMENT

Figure 3:
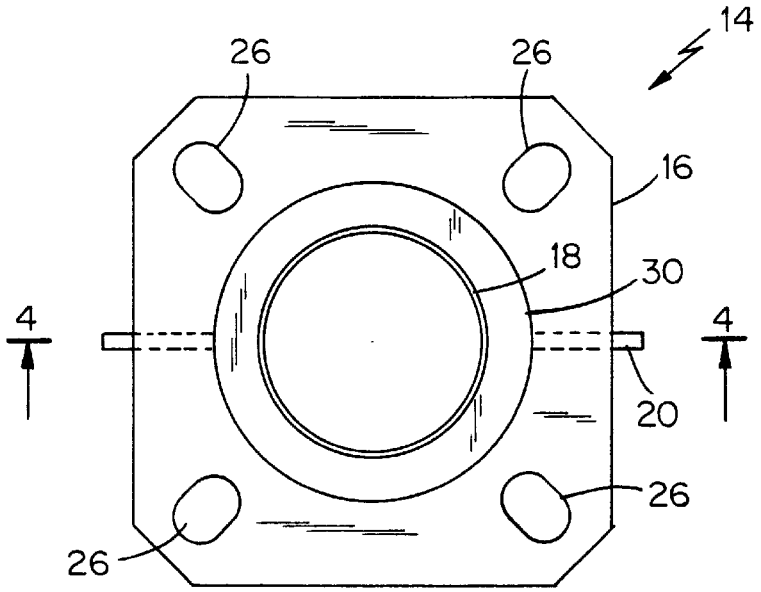
FIG. 3 is a planned view of the of the drain pan of this invention.

With attention to the drawings and FIG. 1 in particular there is shown the lower portion of a hollow utility pole 10 mounted on a conventional concrete base 12 by the support pan 14 of this invention. As shown in FIG. 2, the support pan of this invention includes a generally rectangular base plate 16 which supports a cylinder 18 and opposed drain pipes 20. The base plate 16 is secured to the concrete base 12 by conventional bolts which are set in the concrete base 12.

Figure 4:
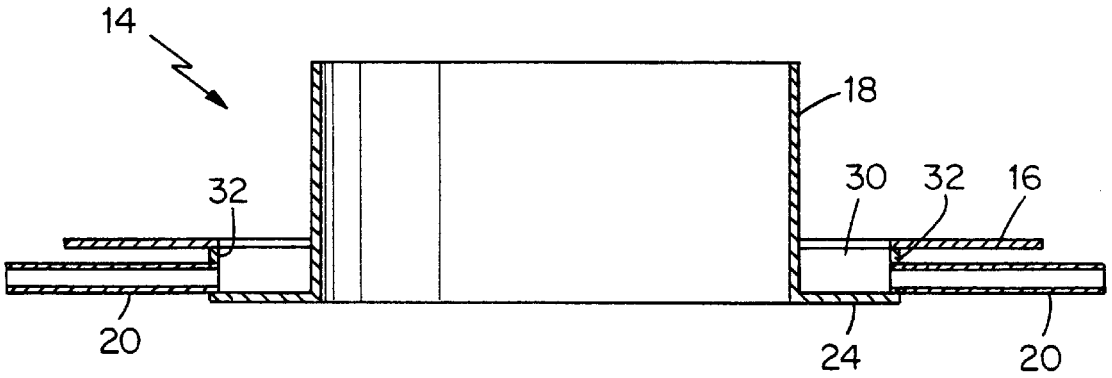
FIG. 4 is a cross-sectional view taken along lines 4—4 of FIG. 3.

With attention to FIGS. 3 and 4, the support pan 14 of this invention is a unitary construction including as the elements thereof, the upper support plate 16, the central axial cylinder 18, the drain pipes 20, and a lower support base 24.

Holes 26 are provided in the upper support plate 16 for receiving the conventional bolts 22 which are set in the concrete base 12. The cylinder 18 is intended to be received within the hollow interior of the utility pole 10 and is typically about four inches in height. As shown in FIG. 2, the electrical conduits 28 extend upwardly through cylinder 18 and upwardly into the pole in the conventional fashion.

The base plate or collar 24 which extends laterally outwardly from the cylinder 18 rests on the upper surface of the concrete mount 12 and as shown in for example FIG. 4, the support plate 16 which supports the base of the hollow utility pole is spaced above collar 24 to provide a toroidal recess 30 which opens into drains 20. Moisture from within the utility pole 10 then collects in toroidal recess 30 outside of cylinder 18 and flows by gravity through drains 20 to be eliminated from within the assembly 14.

The drains 20 are merely pipes which extend outwardly from the toroidal recess 30 and are supported by vertical wall portions 32 at the proximal end thereof. The upwardly opening recess 30 then is formed between cylinder 18 and wall 32 and plates 24.

Figure 5:
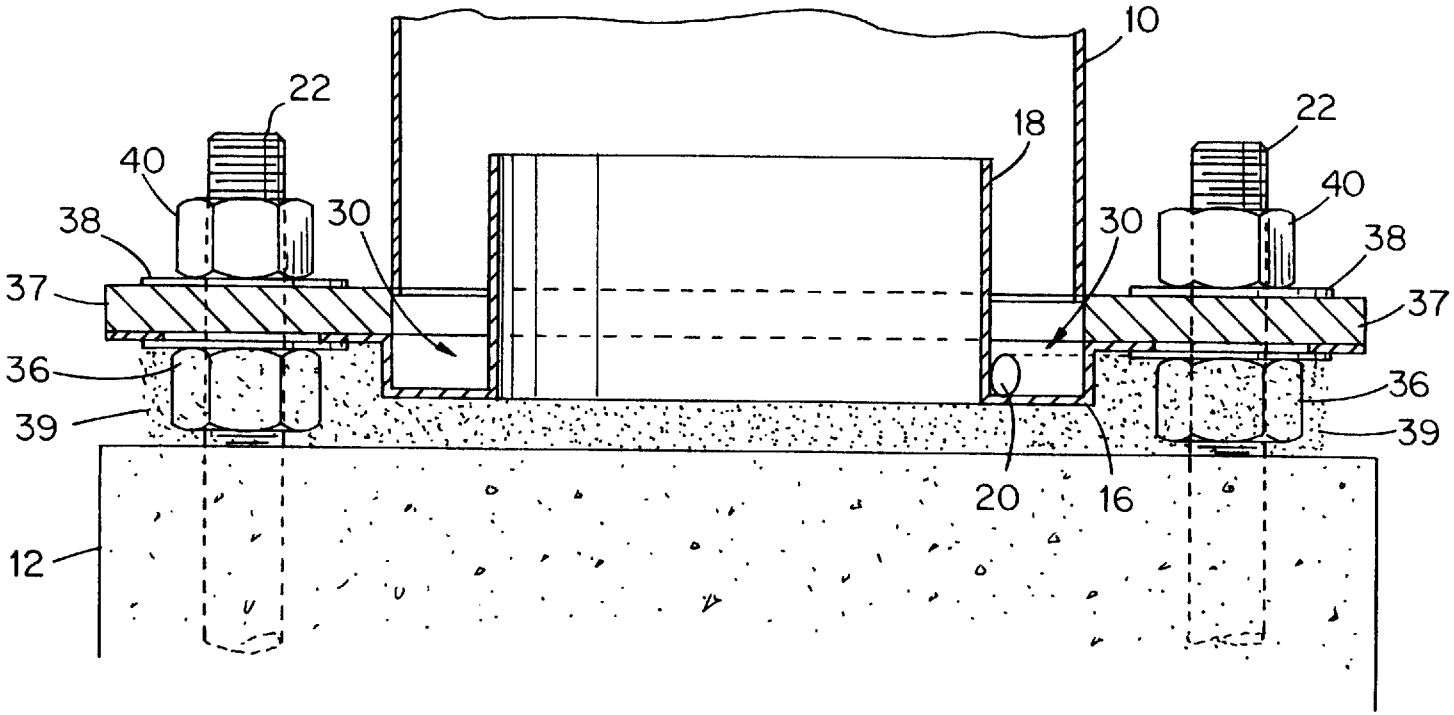
FIG. 5 is a fragmentary front view of the mounting assembly of this invention with the light pole base plate shown.

As can be seen for example in FIG. 5, the plate member 16 which extends outwardly from wall portions 32 does not rest on the upper surface of the concrete support 12. In order to provide for the spacing of the toroidal recess 30, bolts 22 have nut members 36 which are seated on the surface of the support member 12 and which in turn support the mounting plate 16. Nut members 36 then act as vertical stabilizing spacer members, stabilizing ultimately pole 10 against axial rocking motion.

Then when the base plate for the pole assembly 37 is seated on the bolts 22, nut members 40 and 36 with washers 38 secure the base plate 37 and mounting plate 16 to the concrete support 12 through bolts 22. In this way the pole assembly 10 will be secured to base 12 without instability generated by the toroidal recess 30 provided for the drains 20. High strength grout 39 is placed between the support 12 and plate 16 after the pole 10 has been plumbed to spread the resulting load evenly around support 12 in the conventional fashion.

In summary this invention relates to a mounting plate or pan for a hollow utility pole which provides for draining the interior of the utility pole as moisture collects therein without interjecting instability in the mount.

A conventional concrete or equivalent base is provided for supporting the conventional pole, but the coupling between the pole and the concrete base provides for a toroidal recess wherein moisture collecting within the pole can accumulate and drain by gravity therefrom.

It will be readily seen by one of ordinary skill in the art that the invention fulfills all of the objects set forth above. After reading the foregoing specification, one of ordinary skill will be able to effect various changes, substitutions or equivalents and various other aspects of the invention as broadly disclosed herein. It is therefore intended that the protections granted hereon be limited only by the definition contained in the appended claims and equivalents thereof.

What is claimed is:

1. A drain pan for a hollow utility pole having a base plate integral therewith said pole base plate being mounted on a support structure with said pan disposed therebetween comprising:

a lower pole support plate defining a central opening therein, an inner cylinder extending upwardly through said opening in a sealing relationship therewith; an outer cylinder mounted coaxially on said lower plate with said inner cylinder and having a diameter greater than that of said inner cylinder to define with said inner cylinder and lower plate a toroidal recess having an outside diameter substantially the same as the inside diameter of said hollow pole;

an upper support plate mounted on said outer cylinder and having a central opening therethrough substantially the same diameter as the toroidal recess;

means for securing the pole base plate to said upper support plate for registering the hollow pole with the toroidal recess; and drain means carried by said pan and extending through said outer cylinder for draining any moisture accumulating in said recess.

2. The pan of claim 1 further comprising:

spacer means disposed outside said outer cylinder, between said support structure and said upper plate and around the periphery thereof for maintaining a predetermined vertical space therebetween when said pole is mounted on said support.

3. The pan of claim 1 wherein said drain means comprising at least one pipe extending radially outwardly from the longitudinal axis of said pole.

4. The pan of claim 3 wherein two pipes are provided, spaced 180° apart on said axis.

5. The pan of claim 1 wherein said securing means includes bolts disposed around he periphery of said pan, extending upwardly therethrough from said support structure and nuts threadably received at the distal portions thereof coupling said base plate to said upper support plate.

6. The pan of claim 5 wherein said spacer means includes couplings threadably received on said bolts and disposed between said upper support plate and said support structure.

* * * * *

UNITED STATES PATENT AND TRADEMARK OFFICE

CERTIFICATE OF CORRECTION

PATENT NO. : 5,878,540

DATED : March 9, 1999

INVENTOR(S) : Jerome N. MORSTEIN

It is certified that error appears in the above-indentified patent and that said Letters Patent is hereby corrected as shown below:

Column 1, line 26, "boit sot"
should be changed to the following --bolt so--.

Signed and Sealed this

Third Day of August, 1999

*Attest:*

Q. TODD DICKINSON

*Attesting Officer*

*Acting Commissioner of Patents and Trademarks*